US008218783B2

(12) United States Patent
Katzer et al.

(10) Patent No.: US 8,218,783 B2
(45) Date of Patent: Jul. 10, 2012

(54) MASKING BASED GAIN CONTROL

(75) Inventors: Roman Katzer, Esslingen (DE); Klaus Hartung, Hopkinton, MA (US)

(73) Assignee: Bose Corporation, Framingham, MA (US)

( * ) Notice: Subject to any disclaimer, the term of this patent is extended or adjusted under 35 U.S.C. 154(b) by 750 days.

(21) Appl. No.: 12/342,759

(22) Filed: Dec. 23, 2008

(65) Prior Publication Data

US 2010/0158263 A1 Jun. 24, 2010

(51) Int. Cl.
*H04R 3/02* (2006.01)

(52) U.S. Cl. ..... 381/73.1

(58) Field of Classification Search ..... 381/73.1
See application file for complete search history.

(56) References Cited

U.S. PATENT DOCUMENTS

| | | | |
|---|---|---|---|
| 4,054,849 | A | 10/1977 | Yamada |
| 4,061,875 | A | 12/1977 | Freifeld et al. |
| 4,123,711 | A | 10/1978 | Chow |
| 4,455,675 | A | 6/1984 | Bose et al. |
| 4,494,074 | A | 1/1985 | Bose |
| 4,641,344 | A | 2/1987 | Kasai et al. |
| 4,868,881 | A | 9/1989 | Zwicker et al. |
| 4,891,605 | A | 1/1990 | Tirkel et al. |
| 4,944,018 | A | 7/1990 | Bose et al. |
| 4,985,925 | A | 1/1991 | Langberg et al. |
| 5,034,984 | A | 7/1991 | Bose |
| 5,208,866 | A | 5/1993 | Kato et al. |
| 5,388,185 | A | 2/1995 | Terry et al. |
| 5,434,922 | A | 7/1995 | Miller et al. |
| 5,615,270 | A | 3/1997 | Miller et al. |
| 5,666,426 | A | 9/1997 | Helms |
| 5,682,463 | A | 10/1997 | Allen et al. |
| 5,832,444 | A | 11/1998 | Schmidt |
| 5,907,622 | A | 5/1999 | Dougherty |
| 6,072,885 | A | 6/2000 | Stockham, Jr. et al. |
| 6,236,731 | B1 | 5/2001 | Brennan et al. |
| 7,050,966 | B2 | 5/2006 | Schneider et al. |
| 7,317,802 | B2 | 1/2008 | Wurtz |
| 2002/0086072 | A1 | 7/2002 | Allen et al. |
| 2003/0002659 | A1 | 1/2003 | Erell |
| 2003/0064746 | A1 | 4/2003 | Rader et al. |
| 2003/0118197 | A1 | 6/2003 | Nagayasu et al. |
| 2003/0198357 | A1 | 10/2003 | Schneider et al. |
| 2005/0175194 | A1 | 8/2005 | Anderson |
| 2005/0226444 | A1 | 10/2005 | Coats |
| 2006/0126865 | A1* | 6/2006 | Blamey et al. ..... 381/102 |

(Continued)

FOREIGN PATENT DOCUMENTS

| | | |
|---|---|---|
| CN | 1289500 | 3/2001 |

(Continued)

OTHER PUBLICATIONS

Partial International Search Report and Written Opinion dated Oct. 22, 2010 for Int. Appl. No, PCT/US2009/066321.

(Continued)

*Primary Examiner* — Zandra Smith
*Assistant Examiner* — Paul Patton

(57) ABSTRACT

Interfering signals that may be present in a listening environment are masked by reproducing a desired signal in a listening environment, determining a masking threshold associated with the desired signal, identifying an interfering signal that may be present in the environment, comparing the interfering signal to the masking threshold, and adjusting the desired signal over time to raise its masking threshold above the level of the interfering signal.

23 Claims, 13 Drawing Sheets

U.S. PATENT DOCUMENTS

| | | | | |
|---|---|---|---|---|
| 2006/0251261 | A1 | 11/2006 | Christoph | |
| 2006/0262938 | A1 | 11/2006 | Gauger et al. | |
| 2008/0181422 | A1* | 7/2008 | Christoph | 381/73.1 |

FOREIGN PATENT DOCUMENTS

| | | | |
|---|---|---|---|
| EP | 0661858 | | 7/1995 |
| EP | 1003154 | A2 | 5/2000 |
| EP | 1720249 | A1 | 11/2006 |
| WO | 9922366 | A2 | 5/1999 |
| WO | 0019686 | | 4/2000 |
| WO | 00/30264 | A1 | 5/2000 |
| WO | 0139370 | A2 | 5/2001 |
| WO | 01/45082 | | 6/2001 |
| WO | 2005011111 | | 2/2005 |
| WO | 2006125061 | | 11/2006 |
| WO | 2007113487 | A1 | 10/2007 |

OTHER PUBLICATIONS

International Search Report and Written Opinion dated Sep. 17, 2010 for Int. Appln. No. PCT/US2010/021571.

Hanagami, Nathan Fox. "Adding DSP Enhancement to the BOSE Noise Canceling Headphones", Mather Thesis. Massachusetts Institute of Technology, May 18, 2005.

EP Office Action dated Aug. 20, 2008 in counterpart EP 06760069.2.

Dan Race, New Plantronics Bluetooth Headset Delivers Breakthrough Sound Quality on Both Ends of the Conversion, Las Vegas, NV, International CES, Jan. 8, 2004, http//www.plantronics.com/north_america/en_US/press/release/index.jhtml?id=pr_20040108_002..., downloaded Dec. 19, 2005.

M3500 Bluetooth Headset, Plantronics, Digitally Enhanced Voice with Audio IQ Technology, Printed Feb. 6, 2004 PS533.

International Search Report and Written Opinion dated Oct. 4, 2006 for PCT/US2006/019193.

International Preliminary Report on Patentability dated Nov. 29, 2007 for PCT/US2006/019193.

U.S. Appl. No. 12/367,095, filed Feb. 6, 2009.

CN Office Action dated Oct. 20, 2010 for CN Appl. No. 200680023332.5.

Invitation to Pay Additional Fees dated Oct. 10, 2010 for PCT/US2009/066321.

International Search Report dated Feb. 21, 2011 for PCT/US2009/066321.

JP Office Action dated Oct. 4, 2011 for JP Appl. No. 2008512496.

CN Office Action dated Jul. 12, 2011 for CN Appln. No. 200680023332.5.

Notice of Invitation to Pay Additional Fees dated Apr. 6, 2010 in PCT/US2010/021571.

* cited by examiner

MASKING BASED GAIN CONTROL

BACKGROUND

This description relates to signal processing that exploits masking behavior of the human auditory system to reduce perception of undesired signal interference, and to a system for producing acoustically isolated zones to reduce noise and signal interference.

Ever since audible signals haves been broadcast and reproduced from recordings, a wide variety of content has been provided for selection by listeners. For example, passengers traveling in a vehicle may each have a different favorite radio station or recording (e.g., compact disc, etc.). However, only a single station may be selected at a time for broadcast from the vehicle's radio. Similarly, different passengers may want to listen to different types and genres of recorded material (e.g., music from a compact disc or memory device) with vehicle audio equipment (e.g., compact disc player). However, only a single selection (e.g., compact disc track) at a time may be played back. In addition, the perception of the played back selection may be degraded due to interference from sources of noise both internal and external to the vehicle. For example, along with engine noise and passenger voices, as the vehicle travels through a noisy environment (e.g., a urban center), relatively loud noises may drown out a selected radio station or recording playback and produce a disagreeable listening experience for the passengers.

SUMMARY

In one aspect, a method for masking an interfering audio signal includes identifying a first frequency band of a signal being provided to a first acoustic zone to adjust a masking threshold associated with a second frequency band of the signal. The method also includes applying a gain to the first frequency band of the signal to raise the masking threshold in the second frequency band above an interfering signal.

Implementations may include one or more of the following features. Identifying the first frequency band of the signal may include selecting a band with a maximum level from a group of bands. The first and second bands may be in a Bark domain. Adjusting the first frequency band of the signal may include comparing the masking threshold to the level of the interfering signal. The gain applied to the first signal may be slew rate limited. For applying a gain to the first frequency band, the method may include smoothing the gain to preserve a peak gain value. To preserve the peak value, the method may include extending the peak value. The interfering signal may include various types of signals, such as a signal being provided to a second acoustic zone, an estimate of a noise signal, or other type of signal.

In another aspect, a method for masking an interfering audio signal includes reproducing, in a first location, a first signal having a level. The first signal is also associated with a first frequency range. The method also includes determining a masking threshold as a function of frequency associated with the first signal in the first location. Further, the method includes identifying a level of a second signal present in the first location. The second signal is associated with a second frequency range that different from the first frequency range. The method also includes comparing the level of the second signal present in the first location to the masking threshold. Adjusting the first signal level to raise the masking threshold above the level of the second signal within the second frequency range, is also included in the method.

Implementations may include one or more of the following features. The first and second frequency ranges may be represented in a Bark domain or other similar domain. The adjusting of the first signal may be slew rate limited. Adjusting the first signal level may include applying a gain. Application of such a gain may include smoothing the gain to preserve a peak gain value. Preserving the peak value may include extending the peak value. The second signal may include various types of signals, such as a signal being provided to a second location that signal represents an estimate of a noise signal, or other similar signal. The method may also include adjusting the second signal level as a function of frequency to lower the second signal level below the masking threshold over at least a portion of the second frequency range, to reduce audibility of the second signal in the first location.

In still another aspect, a method includes reproducing in a first location a first signal having a level as a function of frequency. The first signal also has a first frequency range. The method also includes determining a masking threshold as a function of frequency associated with the first signal in the first location. Additionally, the method includes identifying a level as a function of frequency of a second signal present in the first location. The second signal has a second frequency range. The method also includes comparing the level of the second signal present in the first location to the masking threshold. Further, the method includes adjusting the second signal level as a function of frequency to lower the second signal level below the masking threshold over at least a portion of the second frequency range, to reduce audibility of the second signal in the first location.

Implementations may include one or more of the following features. The first and second frequency ranges may be represented in a Bark domain or other similar domains. To adjust the level of the second signal, the method may include reducing a gain. The second signal may include various types of signals, such as a signal being provided to a second location.

In another aspect, a method includes receiving a plurality of data points, wherein each of the data points is associated with a value. The method also includes defining an averaging window having a window length, and, identifying at least one peak value from the data point values. The method also includes assigning the identified peak value to data points adjacent to the data point associated with the identified peak value to produce an adjusted plurality of data points. The combined length of the adjacent data points and the data point associated with the identified peak value is equivalent to the window length. The method also includes averaging the adjusted plurality of data points by using the averaging window to produce a smoothed version of the plurality of data points.

Implementations may include one or more of the following features. The data point associated with the identified peak value may be located at the center of the adjacent data points assigned the peak value. Averaging may include stepping the averaging window along the adjusted plurality of data points.

These and other aspects and features and various combinations of them may be expressed as methods, apparatus, systems, means for performing functions, program products, and in other ways.

DETAILED DESCRIPTION

Figure 1:
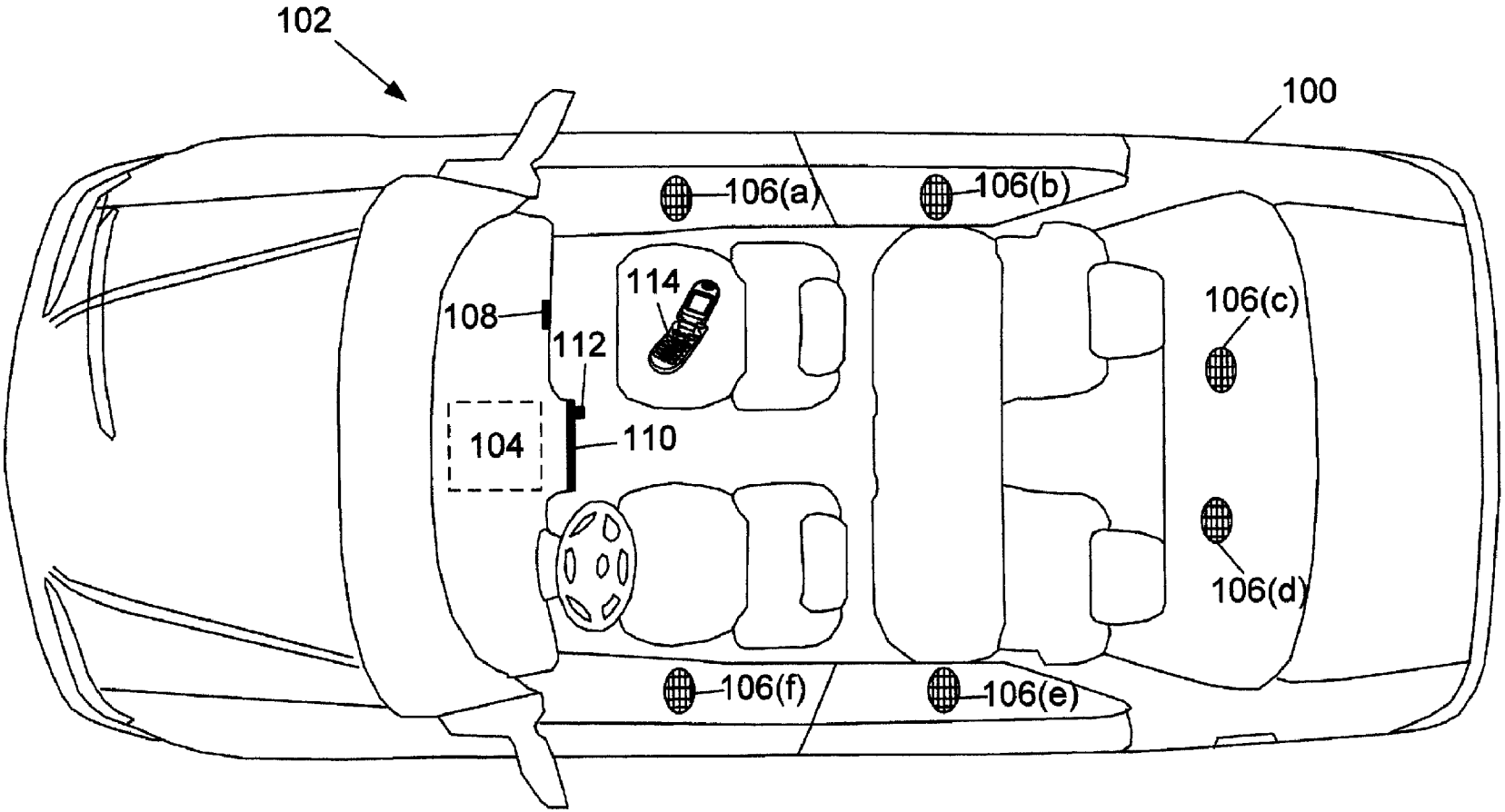
FIG. 1 is a top view of an automobile.

Referring to FIG. 1, an automobile 100 includes an audio reproduction system 102 capable of reducing interference from acoustically isolated zones. Such zones allow passengers of the automobile 100 to individually select different audio content for playback without disturbing or being disturbed by playback in other zones. However, spillover of acoustic signals may occur and interfere with playback. By reducing the spillover, the system 102 improves audio reproduction along with reducing disturbances. While the system 102 is illustrated as being implemented in the automobile 100, similar systems may be implemented in other types of vehicles (e.g., airplanes, buses, etc.) and/or environments (e.g., residences, business offices, restaurants, sporting arenas, etc.) in which multiple people may desire to individually select and listen to similar or different audio content. Along with accounting for audio content spillover from other isolated zones, the audio reproduction system 102 may account for spillover from other types of audio sources. For example, noise external to the automobile passenger cabin such as engine noise, wind noise, etc. may be accounted for by the reproduction system 102.

As represented in the figure, the system 102 includes an audio processing device 104 that processes audio signals for reproduction. In particular, the audio processing device 104 monitors and reduces spillover to assist the maintenance of the acoustically isolated zones within the automobile 100. In some arrangements, the functionality of the audio processing device 104 may be incorporated into audio equipment such as an amplifier or the like (e.g., a radio, a CD player, a DVD player, a digital audio player, a hands-free phone system, a navigation system, a vehicle infotainment system, etc.). Additional audio equipment may also be included in the system 102, for example, speakers 106(*a*)-(*f*) distributed throughout the passenger cabin may be used to reproduce audio signals and to produce acoustically isolated zones. For example, the speakers (*a*)-(*f*), along with other speakers and equipment (as needed), may be used in a system such as the system described in "System and Method for Directionally Radiating Sound," U.S. patent application Ser. No. 11/780,463, which is incorporated by reference in its entirety. Other transducers, such as one or more microphones (e.g., an in-dash microphone 108) may be used by the system 102 to collect audio signals, for example, for processing by the system. Additional speakers may also be included in the system 102 and located throughout the vehicle. Microphones may be located in headliners, pillars, seatbacks or headrests, or other locations convenient for sensing sound within or near the vehicle. Additionally, an in-dash control panel 110 provides a user interface for initiating system operations and exchanging information such as allowing a user to control settings and providing a visual display for monitoring the operation of the system. In this implementation, the in-dash control panel 110 includes a control knob 112 to allow a user input for controlling volume adjustments, and the like.

To reduce spillover and control acoustic energy being radiated into the zones, various signals may be collected and used in processing operations of the audio reproduction system 102. For example, signals from one or more audio sources, and signals of selected audio content may be used to form and maintain isolated zones. Environmental information (e.g., ambient noise present within the automobile interior), which may interfere with a passenger's ability to hear audio, may be sensed (e.g., by the in-dash microphone 108) and used reduce zone spillover. Rather than the in-dash microphone 108 (or multiple microphones incorporated into the automobile), the audio system 102 may use one or more other microphones placed within the interior of the automobile 100. For example, a microphone of a cellular phone 114 (or other type of hand-held device) may be used to collect ambient noise. By wirelessly or hardwire connecting the cellular phone 114, via the in-dash control panel 110, the audio processing device 104 may be provided an ambient noise signal by a cable (not shown), a Bluetooth connection, or other similar connection technique. Ambient noise may also be estimated from other techniques and methodologies such as inferring noise levels based on engine operation (e.g., engine RPM), vehicle speed or other similar parameter. The state of windows, sunroofs, etc. (e.g., open or closed), may also be used to provide an estimate of ambient noise. Location and time of day may be used in noise level estimates, for example, a global positioning system may used to locate the position of the automobile 100 (e.g., in a city) and used with a clock (e.g., noise is greater during daytime) for estimates.

Figure 2:
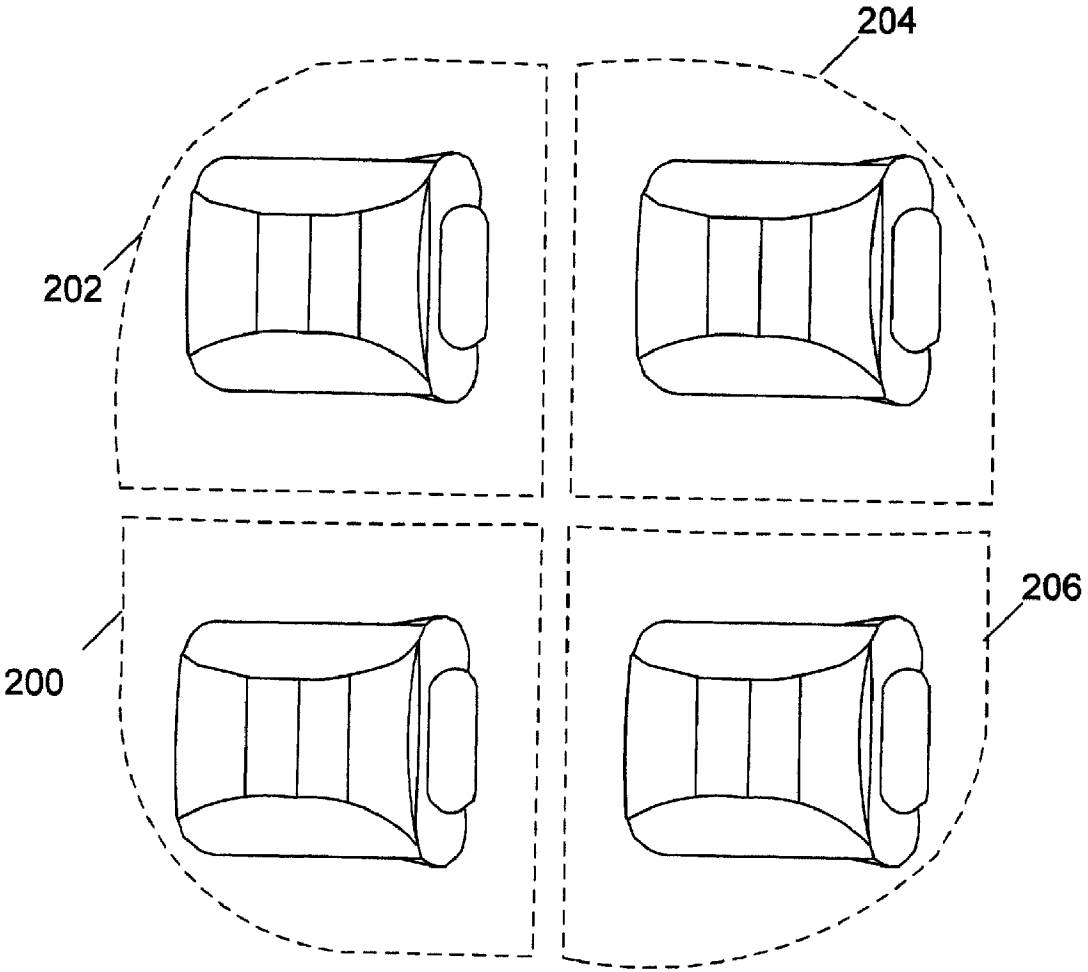
FIG. 2 illustrates acoustically isolated zones within a passenger cabin.

Referring to FIG. 2, a portion of the passenger cabin of the automobile 100 illustrates zones that are desired to be acoustically isolated from each other. In this particular example, four zones 200, 202, 204, 206 are monitored by the reproduction system 102 and each zone is centered on one unique seat of the automobile (e.g., zone 200 is centered on the driver's seat, zone 202 is centered on the front passenger seat, etc.). For the situation in which each of the zones are created to be acoustically isolated, a passenger located in one zone would be able to select and listen to audio content without distracting or being distracted by audio content being played back in one or more of the other zones. In one example, the reproduction system 102 is operated to reduce inter-zone spillover, as described in U.S. patent application Ser. No. 11/780,463, to improve the acoustic isolation. The reproduction system 102 may also be operated to reduce the perceived interference between zones. Further, the zones 200-206 may be monitored to reduce perceived interference from other types of audible signals. For example, perceived interference from signals internal (e.g., engine noise) and external (e.g., street noise) to the automobile 100 may be substantially reduced along with the associated interference of audio content selected for playback.

In general, perceived interference is reduced by masking out-of-zone signals (i.e. undesired signals) with in-zone (i.e. desired) signals. Typically, the complete removal of zone-to-zone spillover may not be achievable and some audible disturbances may be discernible. However, when different audio content is being provided to multiple zones (e.g., one radio station to zone 200 and another radio station to zone 202) and signal processing exploiting auditory masking is implemented, spill-over is less noticeable. While four zones are illustrated in this particular arrangement, the reproduction system 102 may monitor and reduce spillover (both real physical sound leakage and perceived interference) for additional or less zones. Along with the number of zones, zone size may also be adjustable. For example, the front seat zones 200, 202 may be combined to form a single zone and the back seat zones 204, 206 may be combined to form a single zone, thereby producing two zones of increased size in the automobile 100.

Figure 3:
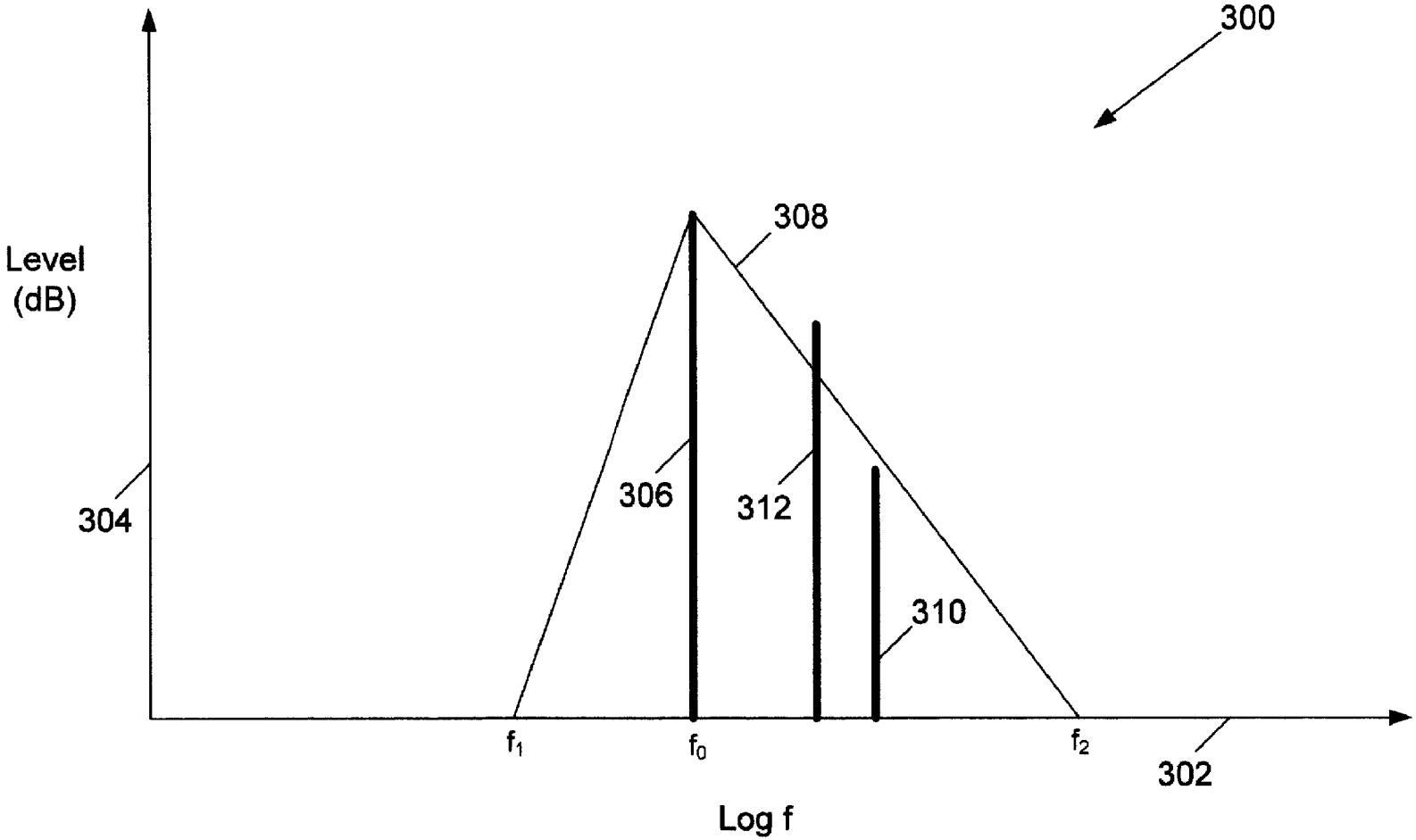
FIGS. 3-5 are charts illustrating masking of acoustic signals.

Referring to FIG. 3, chart 300 graphically illustrates auditory masking in the human auditory system when responding to a received signal. Such masking may be exploited by the reproduction system 102 to reduce perceived spillover among two or more zones. Generally, an audio signal selected for playback (e.g., from a radio station, CD track, etc.) in a particular zone (e.g., zone 200) excites the auditory system. When the selected signal is present, other signals presented to the auditory system may or may not be perceived, depending on their relationship to the first signal. In other words, the first signal can mask other signals. In general, a loud sound can mask other quieter sounds that are relatively close in frequency to the loud sound. A masking threshold can be determined associated with the first signal, which describes the perceptual relationship between the first signal and other signals presented. A second signal presented to the auditory system that falls beneath the masking threshold will not be perceived, while a second signal that exceeds the masking threshold can be perceived.

In chart 300, a horizontal axis 302 (e.g., x-axis) represents frequency on a logarithmic scale and a vertical axis 304 (e.g., y-axis) represents signal level also on a logarithmic scale (e.g., a Decibel scale). To illustrate masking present in the auditory system, a tonal signal 306 is represented at a frequency (on the horizontal axis 302) with a corresponding signal level on the vertical axis 304. When tonal signal 306 is presented to the auditory system, masking threshold 308 can be produced in the auditory system over a range of frequencies. For example, in response to the tonal signal 306 (at frequency $f_0$), the masking threshold 308 extends both above (e.g., to frequency $f_2$) and below (e.g., to frequency $f_1$) the frequency of the tonal signal 306. As illustrated, the masking threshold 308 is not symmetric about the tonal signal frequency $f_0$ and extends further with increasing frequencies than lower frequencies (i.e., $f_2-f_0>f_0-f_1$), as dictated by the auditory system.

When a second acoustic signal is presented to the listener (e.g., an acoustic signal spilling over from another zone), which includes frequencies that fall within the masking threshold curve frequency range (i.e. between frequencies $f_1$ and $f_2$), the relationship between the level of the second acoustic signal and the masking threshold 308 determines whether or not the second signal will be audible to the listener. Signals with levels below the masking threshold curve 308 may not be audible to the listener, while signals with levels that exceed the masking threshold curve 308 may be audible. For example, tonal signal 310 is masked by tonal signal 306 since the level of tonal signal 310 is below the masking threshold 308. Alternatively, tonal signal 312 is not masked since the level of tonal signal 312 is above the masking threshold 308. Thus, the tonal signal 312 is audible while the tonal signal 310 is not heard over tonal signal 306.

Figure 4:
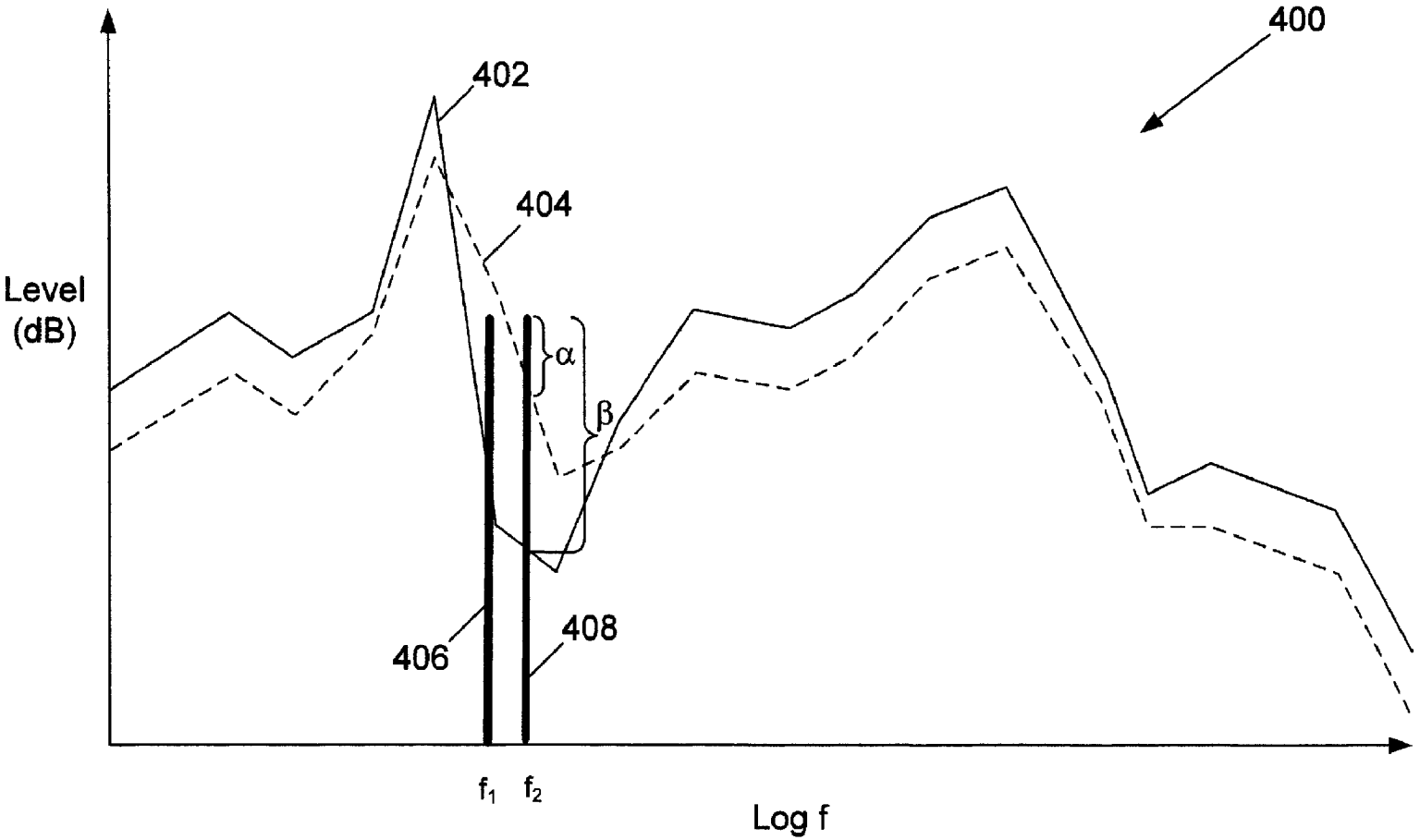

Referring to FIG. 4, a chart 400 illustrates a frequency response 402 of a selected signal (at a particular instance in time) and a corresponding masking threshold 404 of the auditory system associated with that signal. For example a numerical model may be developed to represent a typical auditory system. From the model, auditory system responses (e.g., the masking threshold 404) may be determined for audio signals (e.g., in-zone selected audio signal). While the masking threshold 404 follows the general shape of the frequency response 402, the threshold is not equivalent to the frequency response due to the behavior of the auditory system (which is represented in the auditory system model). Similar to the scenario illustrated in FIG. 3, second (i.e. interfering) signals presented to the auditory system with levels that exceed the masking threshold 404 may be audible while signals presented to the auditory system with levels below the threshold may not be discernible (and considered masked). For example, since the level of a tonal signal response 406 is below the masking threshold 404 (at the frequency of the tonal signal 406, $f_1$), the tonal signal 406 is masked (not discernible by the auditory system). Alternatively, the level of tonal signal 408 exceeds the level of the masking threshold 404 (at the frequency of the tonal signal, $f_2$) and is audible to a listener. Accordingly, adjustments may be applied over time to the in-zone selected audio signal to reduce the number of instances an interfering signal exceeds the masking threshold associated with the selected signal. In some arrangements, if the interfering signal is known and controllable by the audio system, adjustments may be applied to the interfering signal over time to reduce the number of instances the interferer exceeds the masking threshold associated with the selected signal. In some arrangements, both the in-zone selected signal and the interfering signal may be adjusted over a period of time to reduce the number of instances the interfering signal exceeds the masking threshold associated with the selected signal.

One or more techniques may be implemented for adjusting signals to reduce audibility of interfering signals. The level of the desired signal (e.g., an in-zone selected signal represented by frequency response 402) may be increased (e.g., a gain applied) to correspondingly raise its level at an appropriate frequency (e.g., frequency $f_2$), where an interfering signal has energy. Without considering masking, the gain of signal 402 can be increased by an amount ($\beta$), to raise its level above the level of interfering signal 408 at frequency $f_2$. In some instances, the gain of signal 402 can be raised by an amount equal to ($\beta$) plus an offset (e.g. an offset of 1 dB, 2 dB or higher), to ensure the signal 402 completely masks the interferer. Alternatively, the level of the selected signal may be increased (e.g., a gain applied) to correspondingly raise its associated masking threshold at frequency $f_2$ (where interfering signal 408 has energy). The masking threshold only needs to be increased by an amount ($\alpha$) to raise it above the level of interfering signal 408. The gain of the selected signal at frequency $f_2$ can be increased to raise its associated masking threshold above the level of interfering signal 408. In some instances, this can be done by adjusting the gain of signal 402 an amount less than ($\beta$) but greater than ($\alpha$). A gain greater than ($\alpha$) applied to signal 402 at frequency $f_2$ may be required to raise the masking threshold above the level of interfering signal 408 if signal 402 has relatively less energy present at frequency $f_2$ than in adjacent frequencies, and the masking threshold at frequency $f_2$ is primarily a result of the energy present at these nearby frequencies. Alternatively, the gain of the selected signal can be adjusted at a frequency other than $f_2$ to shift its masking threshold by the amount ($\alpha$) needed to raise it above the level of the interfering signal at frequency $f_2$. In this instance, less gain is needed at a frequency other than $f_2$ to raise the masking threshold of the selected signal above the level of the interfering signal at $f_2$ than would be needed to increase the level of the selected signal above the level of the interfering signal at $f_2$. Accordingly, by adjusting the masking threshold 404 for signal masking, the spectral content of selected signal may be altered less. This is shown in FIG. 5 and described in more detail below.

Figure 5:
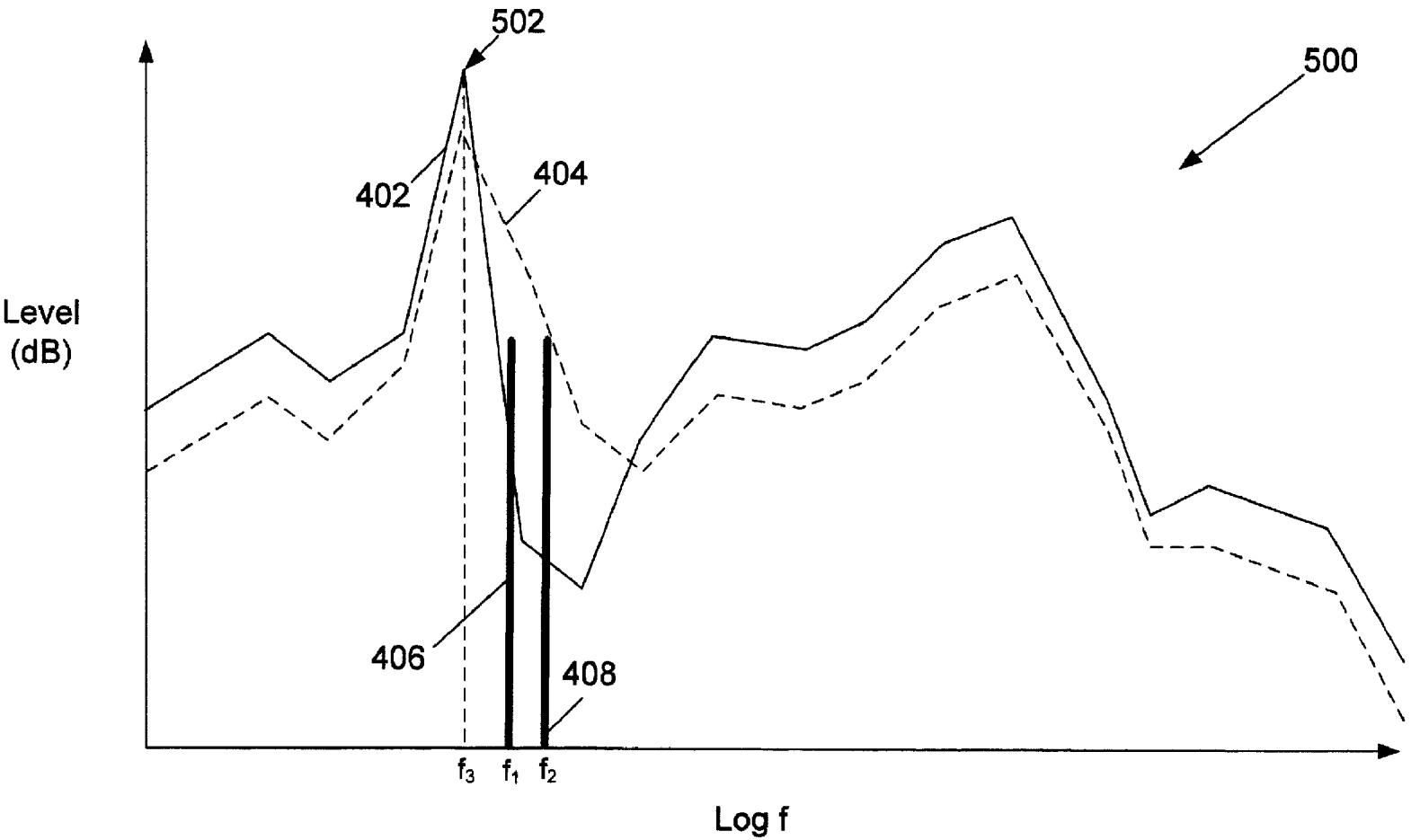

Referring to FIG. 5, a chart 500 illustrates the masking threshold 404 being raised such that both tonal signal responses 406, 408 are beneath the threshold at respective frequencies $f_1$ and $f_2$. In this illustration, a portion of the signal frequency response 402 is adjusted to position the masking threshold 404 above the responses of the interfering signals. By applying a gain, for example, the level of the masking threshold 404 is larger than the level of the tonal signal response 408 (at frequency $f_2$).

A portion of the frequency spectrum of the desired signal may be identified that can control the level of the masking threshold (at the frequency at which interference occurs). For example, one or more portions of the signal frequency response 402 may be identified and adjusted for positioning the masking threshold 404 at an appropriate level (at frequency $f_2$). In this instance, a peak 502 of the signal frequency response 402 is identified as controlling the masking threshold 404 (at frequency $f_2$). By applying a relatively small adjustment of gain to the peak 502 (at frequency $f_3$) of the frequency response 402, an appropriate portion 504 of the masking threshold 404 is raised to a level above the tonal signal 408 (at frequency $f_2$). Thus, by selectively identifying and adjusting one or more appropriate portions of the frequency response 402, the masking threshold 404 may be adjusted for masking interfering signals.

Figure 6:
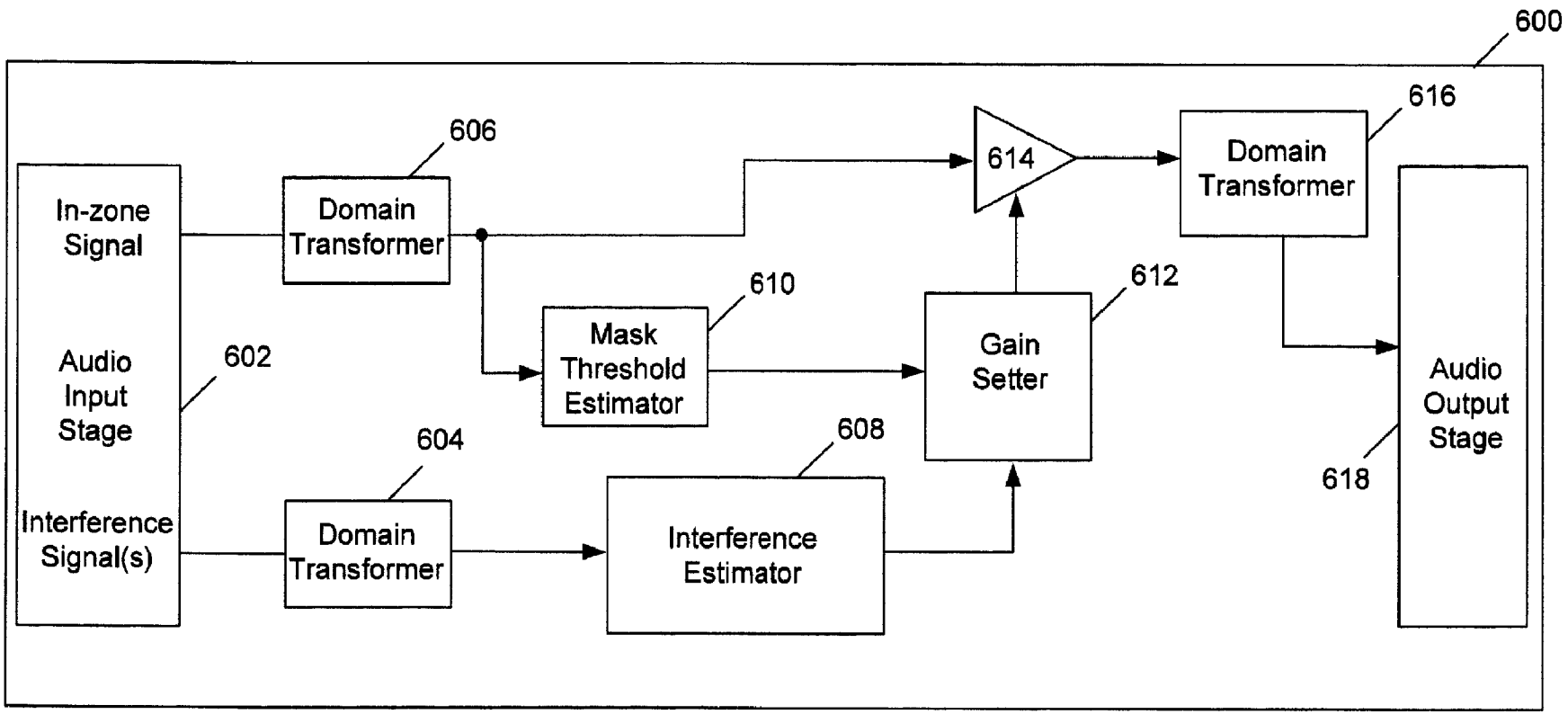
FIG. 6 is a block diagram of an audio processing device.

Referring to FIG. 6, a block diagram 600 represents a portion of the audio processing device 104 that monitors one or more acoustically isolated zones (e.g., zones 200-206) and reduces the effects of undesired signals (e.g., spillover signals) from other locations (e.g., adjacent zones, external noise sources, etc.). For example, the auditory system in response to being presented with signals selected for playback in a zone of interest (e.g., zone 200) exhibits a masking threshold that can mask undesired signals. As such, the audio signal to be produced in the zone of interest (e.g., zone 200), referred to in the figure as the in-zone signal, is provided to an audio input stage 602 of the audio processing device 104. Audio signals selected for playback in the other zones (e.g., zones 202, 204, 206), referred to as the interference signals, are also provided to the audio input stage 602. In some arrangements, other types of signals may be collected by the audio input stage 602, for example, noise signals internal or external to the vehicle may be collected. Further, while the processing of the block diagram 600 described below relates to operation in a single zone, it is understood that redundancy may provide similar functionality to multiple zones.

In this implementation, both in-zone and interference signals are provided to the audio input stage 602 in the time domain and are respectively provided to domain transformers 604, 606 for being segmented into overlapping blocks and transformed into the frequency domain (or other domain such as a time-frequency domain or any other domain that may be useful). For example, one or more transformations (e.g., fast Fourier transforms, wavelets, etc.) and segmenting techniques (e.g., windowing, etc.), along with other processing methodologies (e.g., zero padding, overlapping, etc.) may be used by the domain transformers 604, 606. The transformed interference signals are provided to an interference estimator 608 that estimates the amount of interference (e.g., audio spill-over) provided by each respective interference signal. For example, focusing on the zone 200 (shown in FIG. 2), the amount of signal present in each of the other zones 202, 204 and 206 that spills over into the zone 200 is estimated. To produce such an estimation, one or more signal processing techniques may be implemented, such as determining transfer functions between each pair of zones (e.g., S parameters $S_{12}$, $S_{21}$, etc.). For example, a transfer function may be determined between zone 200 and zone 202, between zone 200 and zone 204, and between zone 200 and zone 206. Once the transfer functions are known, the signals selected for presentation in each of the interfering zones (zones 202, 204, and 206) can be convolved in the time domain (or multiplied in the frequency domain) with the transfer functions to estimate the interfering signal that spills over into zone 200. Once determined, superposition (or other similar techniques) may be used to combine the results from multiple zones. Additional quantities such as statistics and higher order transfer functions may also be computed to characterize the potential zone spillover.

Figure 7:
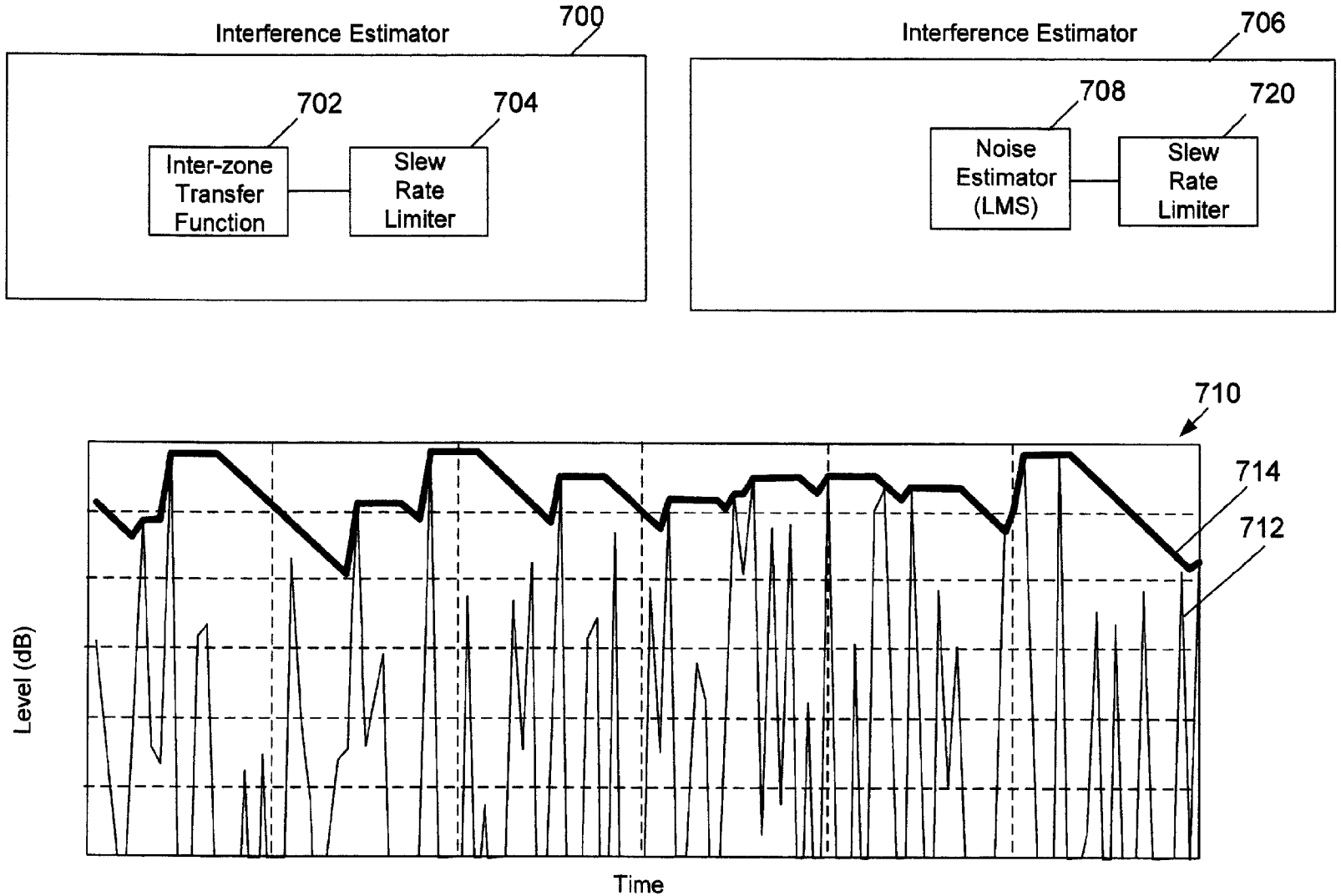
FIG. 7 includes block diagrams of interference estimators.

Referring to FIG. 7, one or more techniques and methodologies may be used by the interference estimator 608 (shown in FIG. 6) to quantify the interference from other zones or noise sources. For example, in one implementation, an interference estimator 700 may include an inter-zone transfer function processor 702 that provides an estimate of the amount of audible spillover between zones. A slew rate limiter 704 may also be included in the interference estimator 700, for example as described below, to reduce cross-modulation of signals between isolated zones. In another implementation, an interference estimator 706 may estimate noise levels present at one or more locations (e.g., a zone, external to the passenger cabin, etc.) for adjusting one or more masking thresholds to reduce noise effects. A slew rate limiter 720 may also be included in the interference estimator 706, to reduce modulation of desired signals by interfering noise. For example, a noise estimator 708 (included in the interference estimator 706) may use one or more adaptive filters (e.g., least means squares (LMS) filters, etc.) for estimating noise levels, as described in U.S. Pat. Nos. 5,434,922 and 5,615,270 which are incorporated by reference herein. Noise levels collected by one or more microphones (e.g., in-dash 108) may be provided (via the audio input stage 602) to the interference estimator 706 for estimating noise levels to adjust a masking threshold. In some implementations, the functionality of both interference estimators 700, 706 may be used such that masking thresholds may be determined based on multiple types of noise signals (e.g., present in the zones, external to the zones, etc.) and the audible signals being provided to one or more zones for playback.

The slew rate limiters 704, 720 apply a slew rate to the output of the interference estimators 700, 706 to reduce audible and objectionable modulation. As such, the peaks of the interference signals are held for a predefined time period prior to being allowed to fade. For example, slew rate limiters 704, 720 may hold peak interference signal levels from 0.1 to 1.0 second prior to allowing the signal levels to fade at a predefined rate (e.g., 3 to 6 dB per second). Referring to chart 710, a trace 712 represents an interference signal as a function of time for a single frequency band (or bark band as described below), which is provided to the slew rate limiter 704, and a trace 714 represents the slew rate limited interference signal. As represented in the trace 714, each peak value is held for an approximately constant period of time prior to fading at a predefined rate. The signal level increases without being hindered for instances in which another peak occurs as time progresses. By including slew rate limiters 704, 720 the rhythmical structure of the interference signal is significantly prevented from appearing as an audible artifact (e.g., a modulation) within the in-zone signal. Further, gains can be adjusted in a rapid manner without overdriving the in-zone signal while reducing cross-modulation of signals between zones. In an implementation where the interference estimators divide the interfering signal into multiple frequency (or bark) bands, multiple bands are processed in parallel according to the method described above.

Returning to FIG. 6, a mask threshold estimator 610 is included the block diagram 600 to estimate one or more masking thresholds associated with the in-zone signal. In this implementation, the in-zone frequency domain signals are received by the transformer 606 and scaled to reflect auditory system responses (e.g., frequency bins of frequency domain signals are transformed based on a human hearing perception model). For example, the signals may be converted to a Bark scale, which defines bandwidths based upon the human auditory system. In one implementation, Bark values may be computed from frequency in Hz by using the following equation:

$$f_{Bark} = 13 \cdot \arctan\left(\frac{f_{Hz}}{1316}\right) + 3.5 \cdot \arctan\left(\left(\frac{f_{Hz}}{7500}\right)^2\right). \quad (1)$$

Equation (1) is one particular definition of a Bark scale, however, other equations and mathematical functions may be used to define another scale. Further, other methodologies and techniques may be used to transform signals from one domain (e.g., the frequency domain) to another domain (e.g., the Bark domain). Along with the mask threshold estimator 610, signals provided from the interference estimator 608 are transformed to the Bark scale prior to being provided to a gain setter 612. In one implementation, both the mask threshold estimator 610 and the interference estimator 608 convert a frequency range of 0 to 24,000 Hz into a Bark scale that approximately ranges 0 to 25 Bark. Further, by dividing each Bark band into a predefined number of segments (e.g., three segments), the number of Bark bands is proportionally increased (e.g., to 75 Bark sub-bands).

Along with transforming the frequency domain signal onto the Bark scale, the mask threshold estimator 610 determines a masking threshold based upon the in-zone signal level for each Bark band. The mask threshold estimator 610 identifies, for each bark band, the bark band of the in-zone signal most responsible for the threshold. This can be understood as follows.

When a signal has energy present in a first frequency (e.g. bark) band, it has an associated masking threshold in that bark band. The masking threshold also extends to nearby bark bands. The level of the threshold rolls off with some slope (determined by characteristics of the auditory system), on either side of the first bark band where energy is present. This is shown in curve 308 of FIG. 3 for a single tone, but is similar for a Bark band. The slopes are determined by characteristics of the human auditory system, and have experimentally been determined to be on the order of −24 to −60 dB per octave. In general, the slopes going down in frequency are much steeper than slopes going up in frequency. In one implementation, slopes of −28 dB/octave (going up in frequency) and −60 dB/octave (going down in frequency) were used. In other implementations, other slope values may also be incorporated. Depending on the slopes and the level of energy present in the signal in nearby bands, the masking threshold in a first bark band may be controlled by the energy in that first bark band, or it may be controlled by the energy in other nearby bark bands. When mask threshold estimator 610 determines the masking threshold for in zone signal 402, it keeps track of which bark band is primarily responsible for the masking threshold in each bark band of the signal. For signal 402, mask threshold estimator 610 superimposes the mask threshold curves for all individual bark bands and chooses the maximum curve in each band as the mask threshold in that band. That is, it overlays curves similar to curve 308 of FIG. 3 for each bark band (scaled by the amount of energy in each bark band) and picks the highest one in each band. Mask threshold estimator 610 then keeps track of which bark band was responsible for the threshold in each bark band. The mask threshold estimator 610 may also subtract an offset from the determined threshold. The offset is arbitrary, but can be 1 dB, 2 dB, generally any amount less than 6 dB, or some other amount. The purpose is to ensure that the threshold is set lower than it otherwise would be, so that when gain is applied to the selected signal to raise its mask threshold above the level of the interfering signal, slightly more gain is applied than would otherwise be applied without the offset. This reduces the chances that an interfering signal will remain audible above the selected signal. As described above, to control adjustments, the mask threshold estimator 610 identifies a particular Bark band, which may be equivalent (or different) to the band being adjusted. Of course, other techniques and methodologies may be used to identify one or more bands for controlling threshold adjustments.

Figure 8:
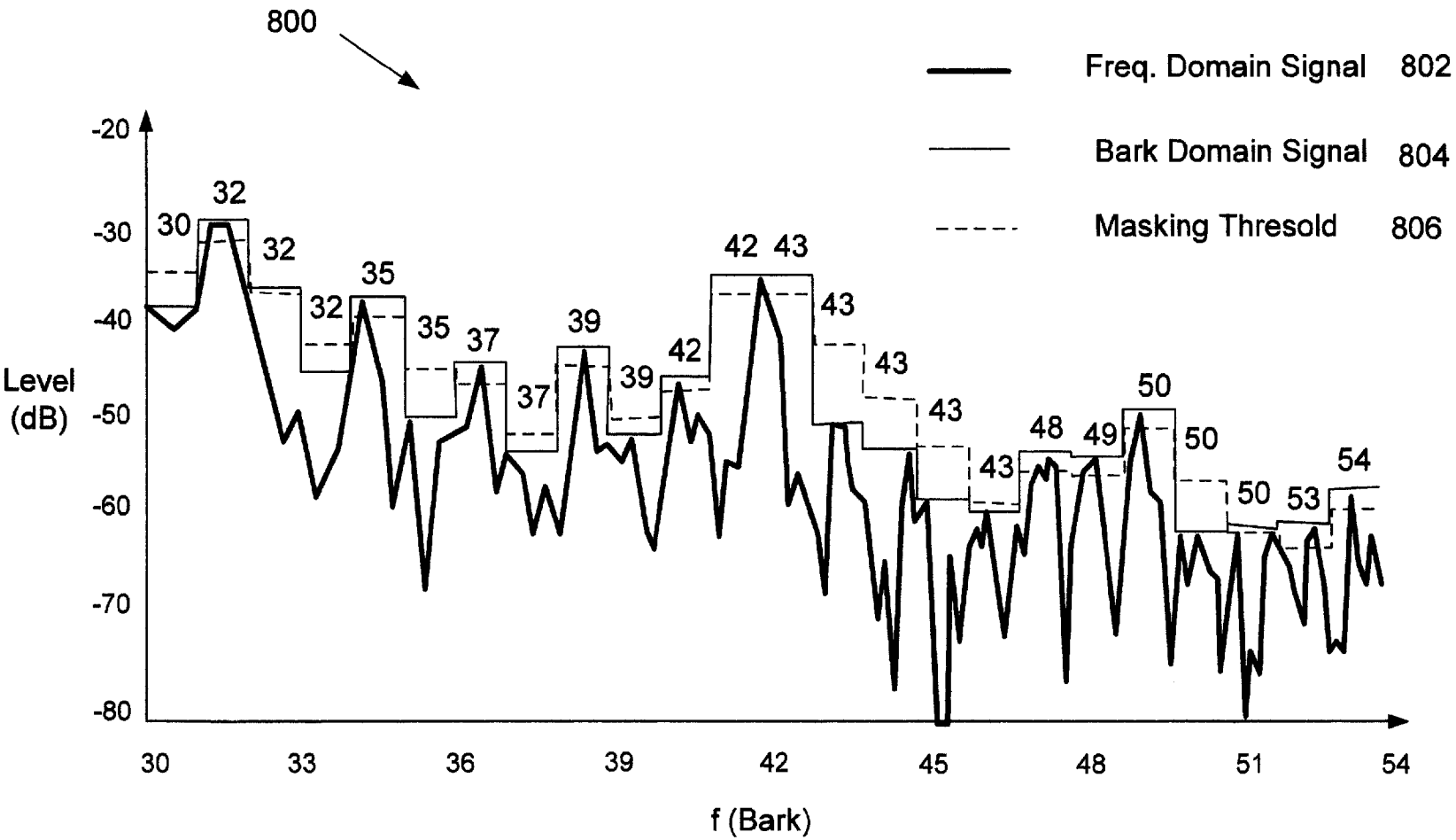
FIG. 8 is a chart of a masking thresholds.

Referring to FIG. 8, a chart 800 represents a portion of a frequency domain signal 802 (from the domain transformer 606) that is converted into a Bark domain signal 804. The displayed portion of the Bark range has values between 10 and 18 and each band is segmented into three sub-bands (to produce a Bark range of 30 to 54, as represented on the horizontal axis). For each Bark domain value of the signal 802, the mask threshold estimator 610 calculates a masking threshold that is represented by a signal trace 806. Additionally, the mask threshold estimator 610 identifies the particular Bark band that primarily controls adjustments for each calculated masking threshold. Referring to the chart, an integer number is placed over each band to identify the Bark band primarily responsible for the masking threshold, which is the bark band that should be adjusted to most strongly affect the mask threshold. For example, adjustments to the masking threshold in Bark bands 32, 33 and 34 are control by adjusting Bark band 32 (as indicated by the three instances of the number "32" labeled over the bands 32-34).

One or more techniques may be implemented to select particular Bark bands for controlling adjustments to other Bark bands, or the same Bark band. For example, particular bands may be grouped and the group member with the maximum masking threshold may be used adjust the group members. Referring to the figure, a group may be formed of Bark Bands 32-34 and the group member with the maximum threshold may be identified by the mask threshold estimator 610. In this instance, Bark band 32 is associated with the maximum masking threshold and is selected to control group member adjustments. Various parameters may be adjusted for such determinations, for example, groups may include more or less members. Other methodologies, separate from or in combination with determining a maximum value, may be implemented for identifying particular Bark bands. For example, multi-value searches, value estimation, hysteresis and other types of mathematical operations may be implemented in identifying particular Bark bands.

Returning to FIG. 6, upon receiving the masking threshold from the mask threshold estimator 610 and the estimate of the interference signals from the interference estimator 608, the gain setter 612 determines the appropriate gain(s) to apply to the in-zone signal such that the masking threshold of the selected in-zone signal exceeds the interference signals (e.g., spillover signals from other zones, noise, etc.). In general, the gain setter 612 compares the masking threshold (from the in-zone signal) to the interference signals (on a Bark band basis) to determine if signal adjustment(s) are warranted. If needed, one or more gains are identified for applying to signal portion associated with the controlling Bark band or bands (e.g., gain is applied to signal portions associated with Bark band 32 for adjusting the masking threshold in Bark band 33, if an interfering signal has a level in Bark band 33 that would be higher than the masking threshold associated with the unmodified in-zone signal).

Figure 9:
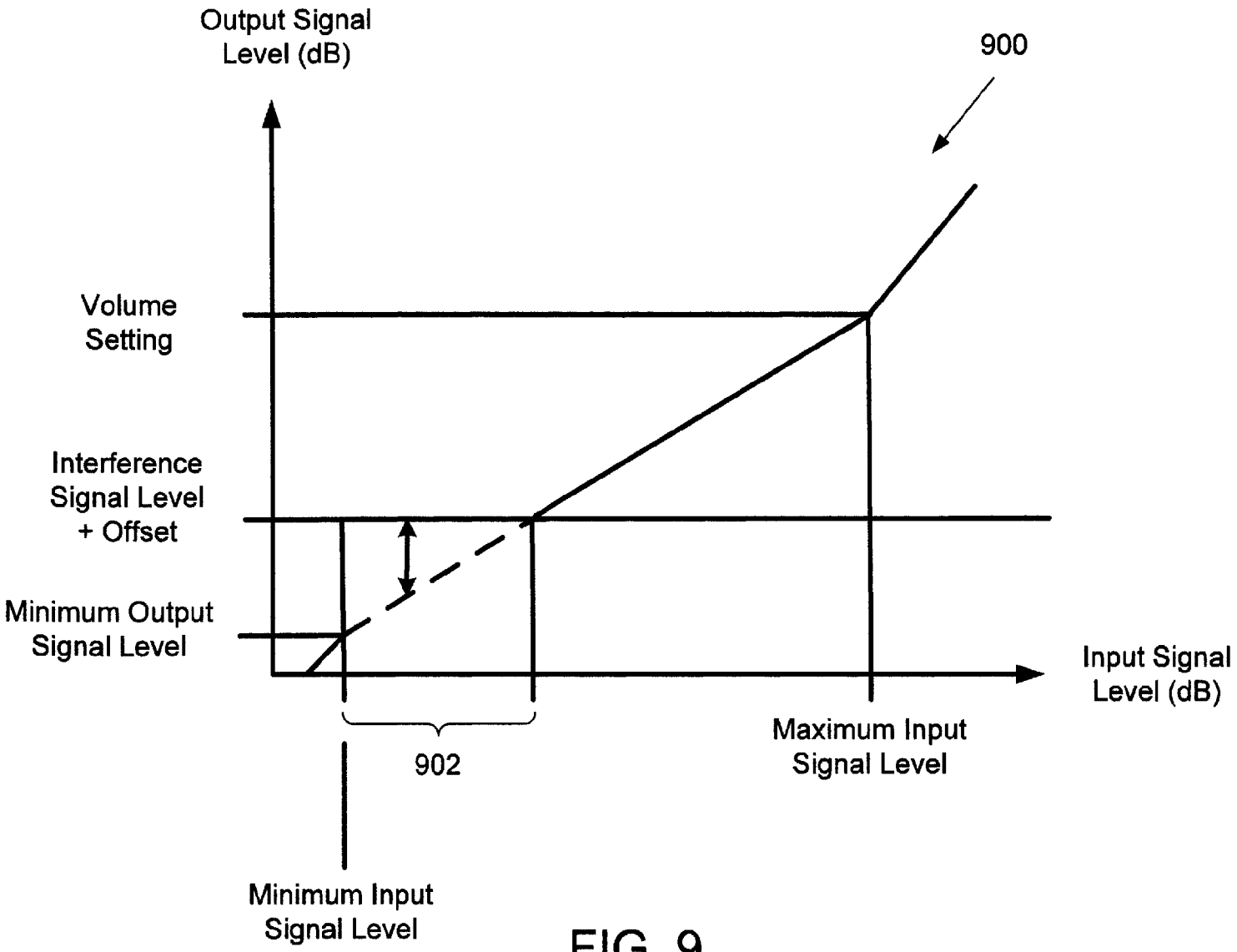
FIG. 9 is a chart of acoustic signal input level versus output level.

Referring to FIG. 9, a chart 900 illustrates the application of gain to an in-zone signal (at a particular Bark band) to adjust a masking threshold at one or more Bark bands. The chart 900 includes a horizontal axis that represents the level of the in-zone signal and a vertical axis that represents the output signal level (upon gain being applied). Generally, the input in-zone signal and the output signal have minimum and maximum levels. The maximum output level may be user selected (e.g., provided by a maximum volume setting) while the minimum output level may be determined from level of the estimated interference signal plus an offset value to mask the interference signal. As such, an appropriate gain or gains are applied to an in-zone signal range 902 defined by the minimum in-zone signal level and the in-zone signal level that is equivalent to the interference signal level plus the offset. As such, appropriate gain is applied to signal levels in need of adjustment to exceed interference levels.

Returning to FIG. 6, along with determining the gain needed to adjust the masking thresholds and identifying appropriate Bark bands for controlling the adjustments, the gain setter 612 also determines the appropriate gain values in the frequency domain. As such, gains identified in the Bark domain are converted into the frequency domain. For example, a function may be defined using equation (1) to convert the gains from the Bark domain into the frequency domain. Along with providing conversion into the frequency domain, other operations may be provided by the gain setter 612 for preparing gains for application to in-zone signals. For example (as described below), gain values may be smoothed prior to application.

Figure 10:
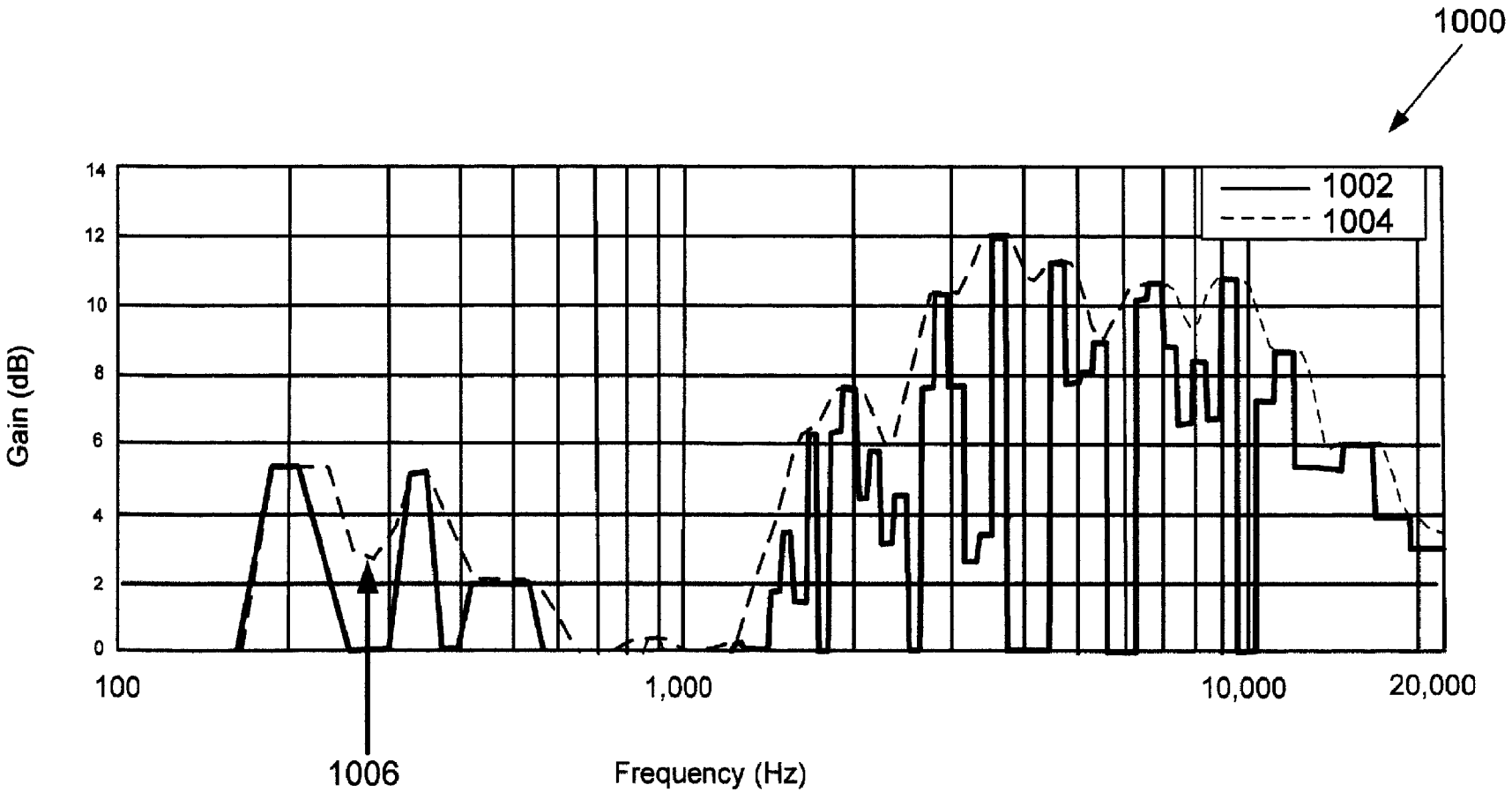
FIG. 10 is a chart of gain versus frequency.

Referring to FIG. 10, a chart 1000 illustrates a set of gains determined by the gain setter 612 to produce a masking threshold for a particular time instance. Converted from the Bark domain to the frequency domain, a solid line 1002 represents the gains across a range of frequencies (100 Hz to 20,000 Hz) as represented on the horizontal axis. In this illustration, the gains derived in the Bark domain are converted into corresponding frequency bins. With reference to equation (1), at lower frequencies, one band in the Bark domain may be equivalent to one bin in the frequency domain. However at higher frequencies, one Bark band may contain a few hundred frequency bins. As such, the gains (as represented with trace 1002 using a logarithmic frequency axis) appear to compress with frequency and are relatively discontinuous and block-like in the frequency domain. Converted into the time domain, such a gain function typically produces impulse responses with extended time periods and that are susceptible to aliasing.

To reduce the length of the impulse responses and concentrate signal energy in time, a smoothing function is applied to the gains (represented with trace 1002) using one or more techniques and methodologies. However, to properly mask the interference signals, the peak gain levels need to be retained. As such a smoothing technique is implemented that preserves the peaks of the gains. In one exemplary technique, a smoothing function is selected that averages gain values within a window of predefined length. The average gain value is saved and the window is slid up in frequency to repeat the process and calculate a running average while stepping along the frequency axis. To preserve the gain peaks, each peak is detected and widened by an amount equivalent to the window width. As such, when a widened peak is averaged within the window, the peak is preserved. For example, for an averaging window defined as ⅙ octave, each gain peak is widened by 1/12 octave on each side of the peak. Other window sizes may also be implemented.

A dashed line trace 1004 represents the smoothed gains and illustrates the peak preservation. While smoothed gain values may be relatively higher for non-peak values (e.g., highlighted with arrow 1006), each peak value is assured to be retained across the frequency range, and appropriate masking thresholds produced. By applying such smoothing functions, aliasing may be reduced and corresponding impulse responses (of such gains in the time domain) are generally more compact.

Returning to FIG. 6, upon the appropriate gain values being determined by the gain setter 612 and transformed into the linear frequency domain (and smoothed), the gain values are applied to the in-zone signal. In this particular implementation, an amplifier stage 614 is provided the gain values from the gain setter 612 and applies the gains to the in-zone signal in the frequency domain. A domain transformer 616 receives and transforms the output of the gain stage 614 back into the time domain. Additionally, in this implementation, the domain transformer 616 accounts for segmentation (performed by the domain transformer 606) to produce a substantially continuous signal. An audio output stage 618 is provided the time domain signal from the domain transformer 616 and prepares the signal for playback. For example, the signal may be conditioned (e.g., gain applied) by the audio output stage 618 for transfer of the audio content to one or more speakers (e.g., speakers 106(*a*)-(*f*)).

Figure 11:
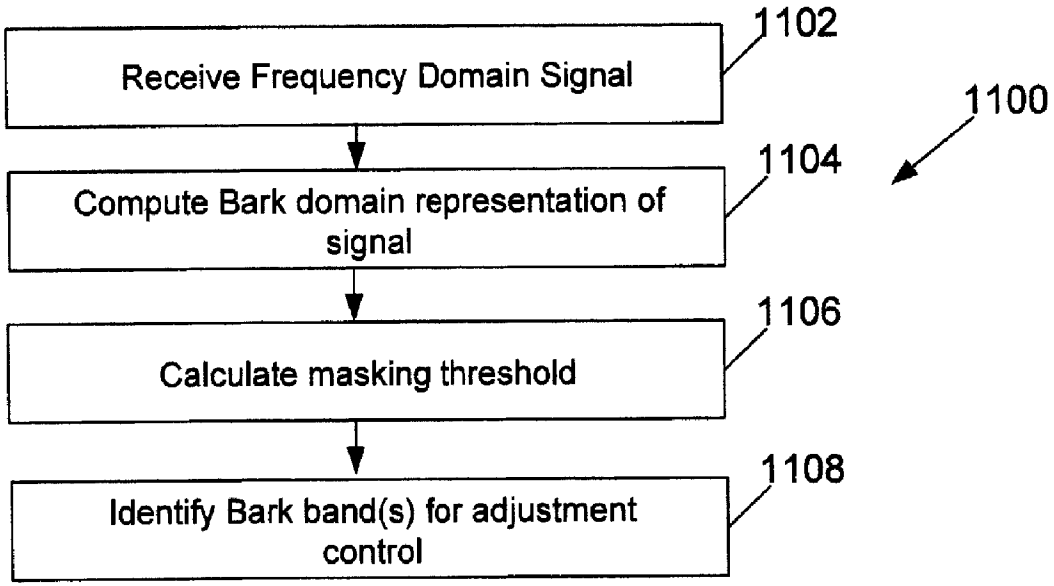
FIG. 11 is a flowchart of operations of a mask estimator.

Referring to FIG. 11, a flowchart 1100 represents some of the operations of the mask threshold estimator 610. As mentioned above, the mask threshold estimator 610 may be executed by the audio processing device 104, for example, instructions may be executed by a processor (e.g., a microprocessor) associated with the audio processing device. Such instructions may be stored in a storage device (e.g., hard drive, CD-ROM, etc.) and provide to the processor (or multiple processors) for execution. Along with an in-vehicle mounted device, the audio processing device may be mountable in other locations (e.g., a residence, an office, etc.). Further, computing devices such as a computer system may be used to execute operations of the mask threshold estimator 610. Circuitry (e.g., digital logic) may also be used individually or in combination with one or more processing devices to provide the operations of the mask threshold estimator 610.

Operations of the mask threshold estimator 610 include receiving 1102 a frequency domain signal and computing 1104 a Bark domain representation of the signal. From the Bark domain representation of the signal, the mask threshold estimator 610 calculates 1106 a masking threshold, for example, an adjustable masking threshold may be calculated for each Bark band. An offset may be subtracted from the calculated threshold in one or more bands. The mask threshold estimator remembers the bark band responsible for the masking threshold in each bark band. To adjust the masking threshold in a Bark band, the mask threshold estimator 610 determines 1108 the appropriate Bark band or bands (the band or bands most responsible for masking) for controlling adjustments. In some examples, bark band groups may be formed and the particular band with the maximum signal level (within a group) is assigned for adjusting each bark band member of the group.

Figure 12:
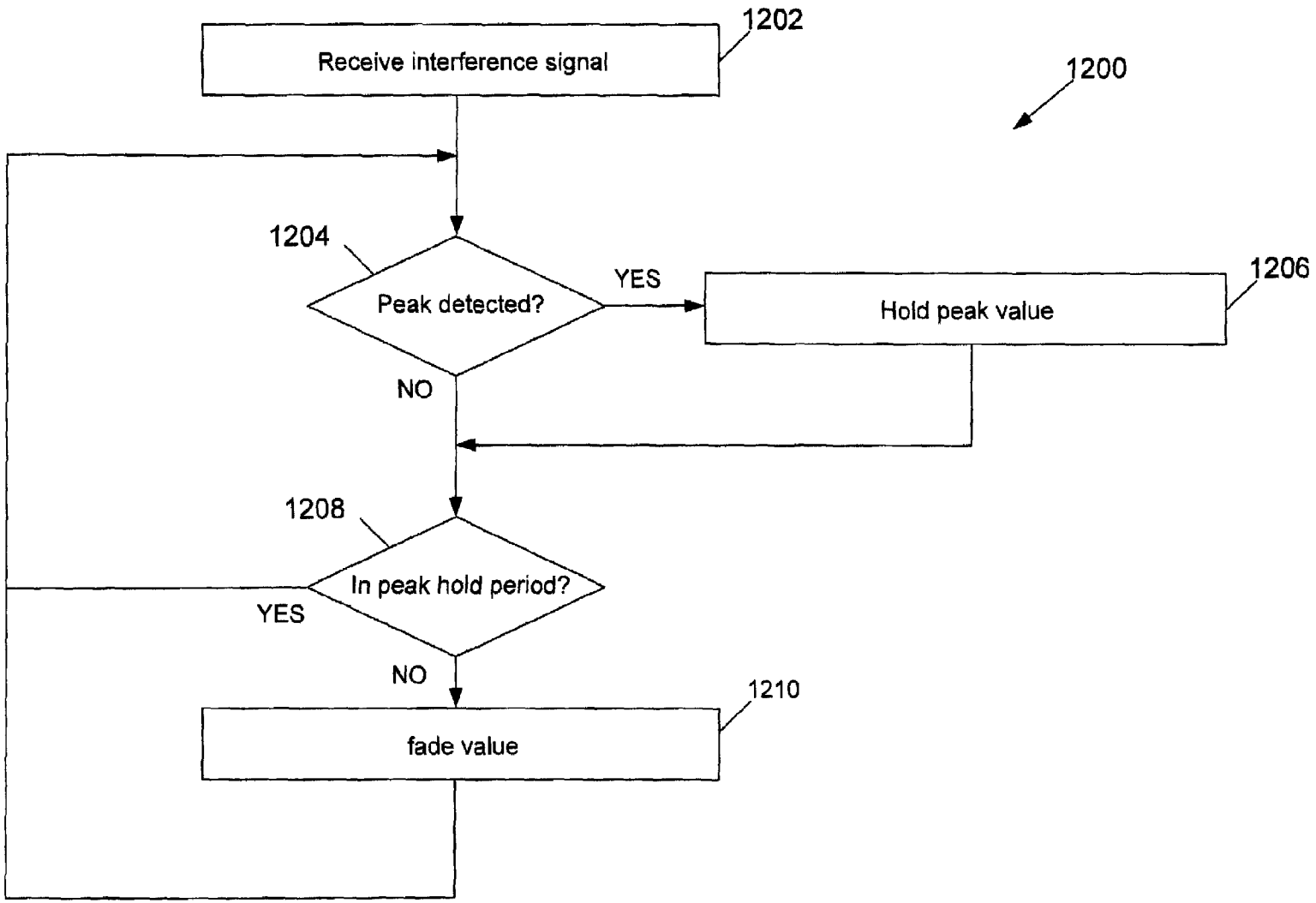
FIG. 12 is a flowchart of operations of a interference estimator.

Referring to FIG. 12, a flowchart 1200 includes some operations of the interference estimator 608. As mentioned with reference to FIG. 7, a slew rate limiter 704, 720 may be included in the interference estimator to reduce modulation artifacts of interference signals from appearing within in-zone signals. Similar to the mask threshold estimator 610, operations of the interference estimator 608 may be executed from instructions provided to one or more processors (e.g., a microprocessor), custom circuitry, or other similar processing technique or combination of methodologies.

To provide slew rate limiting, operations of the interference threshold estimator 608 may include receiving 1202 an interference signal (e.g., a frequency or a Bark domain signal obtained from the transfer function between two zones, or a frequency or a Bark domain signal obtained from a microphone measurement) and determining 1204 if a peak is detected. Peak detection is well known in the art, and methods for performing peak detection will not be described in further detail here. In one arrangement, peak detection is provided by monitoring and comparing individual signal levels. If a peak is detected, operations include holding 1206 the peak for a predefined period (e.g., 0.1 second, 1.0 second, etc.). If a peak value has not been detected or upon holding a detected peak value, operations include determining 1208 if a peak value is currently being held. If a peak holding period is not active (e.g., a peak has not been detected), the interference estimator 608 allows the signal to fade 1210. If a peak value is currently being held, operations return to determine if another peak value is detected.

Figure 13:
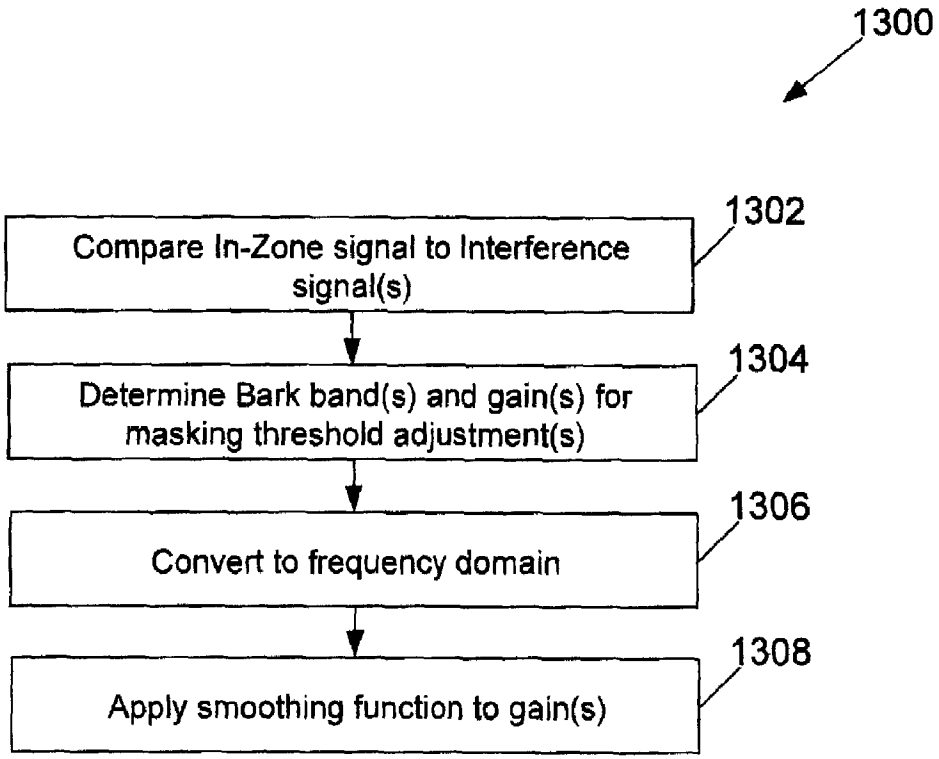
FIG. 13 is a flowchart of operations of a gain setter.

Referring to FIG. 13, a flowchart 1300 includes some operations of the gain setter 612. As mentioned with reference to FIG. 7, along with selecting gain values and converting the values from the Bark domain to the frequency domain, the gain setter 612 applies a smoothing function to the derived gains to preserve peak values. Similar to the mask threshold estimator 610 and the interference estimator 608, operations of the gain setter 612 may be executed from instructions provided to one or more processors (e.g., a microprocessor), custom circuitry, or using other similar processing technique or combination of processing techniques.

To identify the appropriate gains, operations of the gain setter 612 include comparing 1302 an in-zone signal (or multiple in-zone signals) to one or more interference signals. The comparison may be made on Bark band representations of the various signals. Based upon the determination, the gain setter 612 determines 1304 the one or more gains needed for adjusting masking thresholds and the appropriate Bark bands for applying the gains. Operations of the gain setter also include converting 1306 the identified gains from the Bark domain to the frequency domain, dependent upon the how the Bark domain is defined (e.g., equation (1)). Once placed on a linear frequency scale, operations include applying 1308 a smoothing function to the gains. For example, a peak preserving smoothing function may be applied such that peak gain values are retained to insure an appropriate masking signal is produced.

To perform the operations described in the flow charts 1100, 1200 and 1300, the mask threshold estimator 610, the interference estimator 608 and the gain setter 612, individually or in combination, may perform any of the computer-implement methods described previously, according to one implementation. For example, the audio processing device 104 may include a computing device (e.g., a computer system) for executing instructions associated with the mask threshold estimator 610, the interference estimator 608 and the gain setter 612. The computing device may include a processor, a memory, a storage device, and an input/output device or devices. Each of the components may be interconnected using a system bus or other similar structure. The processor may be capable of processing instructions for execution within the computing device. In one implementation, the processor is a single-threaded processor. In another implementation, the processor is a multi-threaded processor. The processor is capable of processing instructions stored in the memory or on the storage device to display graphical information for a user interface on the input/output device.

The memory stores information within the computing device. In one implementation, the memory is a computer-readable medium. In one implementation, the memory is a volatile memory unit. In another implementation, the memory is a non-volatile memory unit.

The storage device is capable of providing mass storage for the computing device. In one implementation, the storage device is a computer-readable medium. In various different implementations, the storage device may be a floppy disk device, a hard disk device, an optical disk device, or a tape device.

The input/output device provides input/output operations for the computing device. In one implementation, the input/output device includes a keyboard and/or pointing device. In another implementation, the input/output device includes a display unit for displaying graphical user interfaces.

The features described (e.g., the mask threshold estimator 610, the interference estimator 608 and the gain setter 612, the operations described in the flow charts 1100, 1200 and 1300) can be implemented in digital electronic circuitry (e.g., a processor), or in computer hardware, firmware, software, or in combinations of them. The apparatus can be implemented in a computer program product tangibly embodied in an information carrier, e.g., in a machine-readable storage device, for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer.

The features can be implemented in a computer system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include, e.g., a LAN, a WAN, and the computers and networks forming the Internet.

The computer system can include clients and servers. A client and server are generally remote from each other and typically interact through a network, such as the described one. The relationship of client and server arises by virtue of computer programs running on the respective computers and having a client-server relationship to each other.

Other embodiments are within the scope of the following claims. The techniques described herein can be performed in a different order and still achieve desirable results.

What is claimed is:

1. A method for audio masking comprising:

identifying a first frequency band of a first audio signal being provided to an audio processing device for reproduction so that sound corresponding to the first audio signal is audible in a first acoustic zone, applying a gain to the first frequency band of the first audio signal to raise the masking threshold in a second frequency band above a level of a second audio signal containing energy in the second frequency band so that sound corresponding to the first audio signal masks sound corresponding to the second audio signal in the first acoustic zone; and providing the second audio signal to the audio processing device for reproduction so that sound corresponding to the second audio signal is audible in a second acoustic zone.

2. The method of claim 1, wherein identifying the first frequency band of the first audio signal includes selecting a band with a maximum level from a group of bands.

3. The method of claim 1, wherein the first and second frequency bands are in a Bark domain.

4. The method of claim 1, wherein applying the gain to the first frequency band of the first audio signal includes comparing the masking threshold to the level of the second audio signal.

5. The method of claim 4, wherein the applied gain is slew rate limited.

6. The method of claim 1, wherein the applying the gain includes smoothing the gain to preserve a peak gain value.

7. The method of claim 6, wherein smoothing the gain includes extending the peak value.

8. A method for audio masking an comprising:

reproducing in a first location a first audio signal having a level in a first frequency range, determining a masking threshold as a function of frequency associated with the first audio signal in the first location, identifying a level in a second frequency range different from the first frequency range of a second audio signal, wherein sound corresponding to the second audio signal is present in the first location, comparing an estimated level in the second frequency range of sound corresponding to the second signal present in the first location to the masking level threshold, adjusting the first audio signal level to raise the masking threshold above the level of the second audio signal within the second frequency range, and reproducing in a second location the second audio signal.

9. The method of claim 8, wherein the first and second frequency ranges are represented in a Bark domain.

10. The method of claim 8 wherein the adjusted level of the first audio signal is slew rate limited.

11. The method of claim 8, wherein adjusting the first audio signal level includes applying a gain.

12. The method of claim 11, wherein applying the gain includes smoothing the gain to preserve a peak gain value.

13. The method of claim 12, wherein smoothing the gain includes extending the peak value.

14. The method of claim 8 further comprising, adjusting the level of the second signal to lower the level of the second signal below the masking threshold over at least a portion of the second frequency range, to reduce audibility of sound corresponding to the second audio signal in the first location.

15. A method for reducing audibility of sound comprising:

reproducing in a first location a first audio signal having a level in a first frequency range, determining in the first frequency range, a masking threshold associated with the first audio signal in the first location, identifying a level in a second frequency range of sound corresponding to a second audio signal present in the first location, comparing an estimate of sound corresponding to the second audio signal present in the first location associated with the level of the second signal to the estimated sound corresponding with the first audio signal associated with the first masking threshold, adjusting the level of the second signal over at least a portion of the second frequency range to lower the level of the first audio signal below the masking threshold to reduce audibility of sound corresponding to the second signal in the first location, and reproducing in a second location the second audio signal.

16. The method of claim 15, wherein the first and second frequency ranges are represented in a Bark domain.

17. The method of claim 15, wherein adjusting the second signal level includes reducing a gain.

18. The method of claim 1, further comprising:

identifying a third frequency band of the second audio signal being provided to an audio processing device for reproduction so that sound corresponding to the second audio signal is audible in the second acoustic zone, and applying a gain to the third frequency band of the second audio signal to raise the masking threshold in a fourth frequency band above a level of the first audio signal containing energy in the fourth frequency band so that sound corresponding to the second audio signal masks sound corresponding to the first audio signal in the second acoustic zone.

19. The method of claim 18, wherein the third frequency range is the same as the first frequency range and the fourth frequency range is the same as the second frequency range.

20. The method of claim 8, further comprising:

reproducing in the second location the second audio signal having a level in a third frequency range, determining a masking threshold as a function of frequency associated with the second audio signal in the second location, identifying a level in a fourth frequency range different from the third frequency range of the first audio signal, wherein sound corresponding to the first audio signal is present in the second location, comparing an estimated level in the fourth frequency range of sound corresponding to the first signal present in the second location to the masking level threshold, and adjusting the second audio signal level to raise the masking threshold above the level of the first audio signal within the fourth frequency range.

21. The method of claim 20, wherein the third frequency range is the same as the first frequency range and the fourth frequency range is the same as the second frequency range.

22. The method of claim 15, wherein the reproducing in a second location the second audio signal comprises reproducing the second audio signal in a third frequency range, the method further comprising determining a masking threshold in the third frequency range, the masking threshold associated with the second audio signal in the second location, identifying a level in a fourth frequency range of the first signal present in the second location, comparing the level of the first signal present in the second location to the masking threshold, and adjusting the level of the first signal over at least a portion of the fourth frequency range to lower the level of the first audio signal below the masking threshold to reduce audibility of sound corresponding to the first signal in the second location.

23. The method of claim 22, wherein the third frequency range is the same as the first frequency range and the fourth frequency is the same as the second frequency range.

* * * * *